US010702071B2

(12) United States Patent
Choi

(10) Patent No.: US 10,702,071 B2
(45) Date of Patent: Jul. 7, 2020

(54) PACKAGING STRUCTURE OF FOLDING BED AND PACKAGING METHOD THEREOF

(71) Applicant: Inno-Sports Co., Ltd, Xiamen (CN)

(72) Inventor: Kwan Jun Choi, Xiamen (CN)

(73) Assignee: Inno-Sports Co., Ltd, Xiamen (CN)

( * ) Notice: Subject to any disclaimer, the term of this patent is extended or adjusted under 35 U.S.C. 154(b) by 313 days.

(21) Appl. No.: 15/951,180

(22) Filed: Apr. 12, 2018

(65) Prior Publication Data

US 2019/0174928 A1 Jun. 13, 2019

(30) Foreign Application Priority Data

Dec. 11, 2017 (CN) ..... 2017 1 1305956

(51) Int. Cl.

| | |
|---|---|
| ***A47C 19/22*** | (2006.01) |
| ***A47C 19/02*** | (2006.01) |
| ***A47C 19/12*** | (2006.01) |
| ***B65D 5/02*** | (2006.01) |
| ***B65D 85/64*** | (2006.01) |
| ***A47C 23/00*** | (2006.01) |
| ***A47C 17/82*** | (2006.01) |

(52) U.S. Cl.

CPC ..... *A47C 19/22* (2013.01); *A47C 17/82* (2013.01); *A47C 19/021* (2013.01); *A47C 19/12* (2013.01); *A47C 19/122* (2013.01); *A47C 23/005* (2013.01); *B65D 5/0227* (2013.01); *B65D 5/0236* (2013.01); *B65D 85/64* (2013.01); *B65D 2585/647* (2013.01)

(58) Field of Classification Search

CPC ..... A47C 19/22; A47C 17/82; A47C 19/122; A47C 19/0221; A47C 19/12; B65D 5/0236; B65D 5/0227; B65D 85/64; B65D 2585/647; B65D 85/65; B65B 5/04; B65B 51/00; B65B 63/04

USPC ..... 206/576

See application file for complete search history.

(56) References Cited

U.S. PATENT DOCUMENTS 712,203 A * 10/1902 Pellettiri ..... A47C 19/122 5/111
815,819 A * 3/1906 Harllee ..... A47C 19/122 5/111
1,420,782 A * 6/1922 Suski ..... A47C 17/82 190/2
2,577,741 A * 12/1951 Creveling ..... A47C 13/00 297/109

(Continued)

*Primary Examiner* — Ernesto A Grano

(74) *Attorney, Agent, or Firm* — Bayramoglu Law Offices LLC

(57) ABSTRACT

The invention discloses a packaging structure of a folding bed and a packaging method thereof. The packaging structure includes a folding bedstead including at least three unit frames, the adjacent unit frames are mutually hinged, and a mattress capable of being rolled up. When the folding bedstead is packaged, a space for receiving the rolled mattress is formed by the unit frames. The packaging method includes the following steps: S1, folding the unit frames of the folding bedstead to form a space; S2, rolling up the mattress and putting the rolled mattress into a space formed by the unit frame; S3, putting the folded folding bedstead into the box. The invention method allows for the most space efficient packing possible thereby reducing the amount of space occupied by the bed and reducing transportation costs.

12 Claims, 6 Drawing Sheets

(56) References Cited

U.S. PATENT DOCUMENTS 3,077,612 A * 2/1963 Sevcik ..... A47C 19/122 5/618
3,268,922 A * 8/1966 Moxley ..... A47C 27/14 5/420
3,638,249 A * 2/1972 Katsigarakis ..... A47C 17/60 5/159.1
4,048,683 A * 9/1977 Chen ..... A47C 19/122 5/180
4,143,434 A * 3/1979 Monot ..... A47C 17/82 5/114
4,153,958 A * 5/1979 Paulik ..... A47C 4/52 297/118
4,513,460 A * 4/1985 McIntire ..... A47C 17/225 5/13
5,303,435 A * 4/1994 Haar ..... A47C 27/084 5/413 AM
5,440,768 A * 8/1995 Danin ..... A47C 17/60 5/3
6,098,378 A * 8/2000 Wyatt ..... B65B 63/026 53/118
6,295,668 B1 * 10/2001 Nation ..... A47C 1/143 5/110
7,770,246 B2 * 8/2010 Chen ..... A47C 19/126 5/111
2003/0019033 A1 * 1/2003 Choi ..... A47C 19/14 5/114
2005/0066624 A1 * 3/2005 Dextraze ..... B65B 63/02 53/399
2007/0044233 A1 * 3/2007 Al-Sabah ..... A47C 17/045 5/7
2007/0074983 A1 * 4/2007 Oh ..... B65D 25/24 206/326
2008/0276872 A1 * 11/2008 Chern ..... A47C 19/122 119/28.5
2010/0017959 A1 * 1/2010 Yoshe ..... A47D 7/04 5/99.1
2010/0138991 A1 * 6/2010 Hartenstine ..... A47D 7/04 5/99.1
2010/0181459 A1 * 7/2010 Wang ..... A47C 19/126 248/419
2013/0111663 A1 * 5/2013 Brown ..... A47C 21/00 5/507.1
2013/0221302 A1 * 8/2013 Cheng ..... A47D 13/063 256/25
2013/0256072 A1 * 10/2013 Farhat ..... A01G 9/16 190/2
2016/0242562 A1 * 8/2016 Karschnik ..... A47C 27/083
2017/0128301 A1 * 5/2017 Wakabayashi ..... A61G 11/006
2018/0000254 A1 * 1/2018 Jin ..... A47C 17/70
2018/0125255 A1 * 5/2018 Jin ..... A47C 19/122
2018/0255936 A1 * 9/2018 Choi ..... A47C 19/122
2018/0271296 A1 * 9/2018 Harrow ..... A47C 19/025
2019/0381830 A1 * 12/2019 Brantley ..... B60B 33/0028
2020/0069067 A1 * 3/2020 Valone ..... A47C 17/60

* cited by examiner

PACKAGING STRUCTURE OF FOLDING BED AND PACKAGING METHOD THEREOF

CROSS REFERENCE TO RELATED APPLICATIONS

This application is based upon and claims priority to Chinese Patent Application No. 201711305956.2, filed on Dec. 11, 2017, the entire contents of which are incorporated herein by reference.

TECHNICAL FIELD

The invention relates to a packaging structure of a folding bed and a packaging method thereof.

BACKGROUND

Currently, folding beds are becoming more and more widely used in people's life, especially in western countries. In western countries almost all families use folding beds, and these folding beds are mainly composed of folding bedsteads and mattresses. While being transported from one location to another, the folding bedsteads and the mattresses are separately packaged, and the unit frames and the support legs of the folding bedsteads can be folded to take up less transportation space. The mattresses are rolled up and packaged in boxes separate from the bedsteads for transport. Therefore, when this method of separate packaging is used, a folding bed has two pieces of goods, which occupies two units of space, leading to a significant increase in the transportation cost.

SUMMARY

In order to solve the above technical problems, the invention aims to provide a packaging structure of a folding bed and a packaging method thereof.

The invention is realized by the following technical schemes:

A packaging structure of a folding bed. The folding bed includes a folding bedstead and the folding bestead has at least three unit frames. The adjacent unit frames are hinged to each other. The folding bed also includes a mattress capable of being rolled up. When the folding bedstead is packaged, the unit frames form a space for receiving the rolled mattress.

Further, a box for receiving the folding bedstead in a packaged state and the rolled mattress is provided.

Further, through holes are formed on one edge of the box, and roller wheels are arranged on the side of one of the unit frames and extend out of the box through the through holes.

Further, the folding bedstead further includes support legs welded under the unit frames.

Further, the support legs perpendicular to the unit frames are welded under the unit frames.

Further, the folding bedstead includes three or four unit frames.

Further, when the folding bedstead is packaged, the adjacent unit frames are perpendicular to each other.

The invention also discloses another technical feature:

A packaging method of the folding bed, including the following steps:

S1: folding the unit frames of the folding bedstead to form a space;

S2: rolling up the mattress and putting the rolled mattress into the space formed by the unit frames;

S3: putting the folded folding bedstead into the box.

Further, before S2, installing the roller wheels on the unit frames, aligning the roller wheels with the through holes of the box, and placing the folding bedstead in the box.

Further, the steps further includes S4: sealing the box.

The packaging structure of the folding bed and the packaging method thereof provided by the invention have the following beneficial effects: the mode of the original two packaging boxes is changed to that of a single packaging box, and the occupied space of the folding bed during transportation is greatly reduced, much more folding beds can be transported in a container, thereby improving the efficiency.

BRIEF DESCRIPTION OF THE DRAWINGS

In order to explain the technical schemes of the present invention more clearly, the drawings used in the description of the embodiments or the prior art will be simply described below, obviously, the drawings in the following description are merely some embodiments of the present invention, those skilled in the art can also obtain other drawings based on these drawings without any creative work.

DETAILED DESCRIPTION

Figure 1:
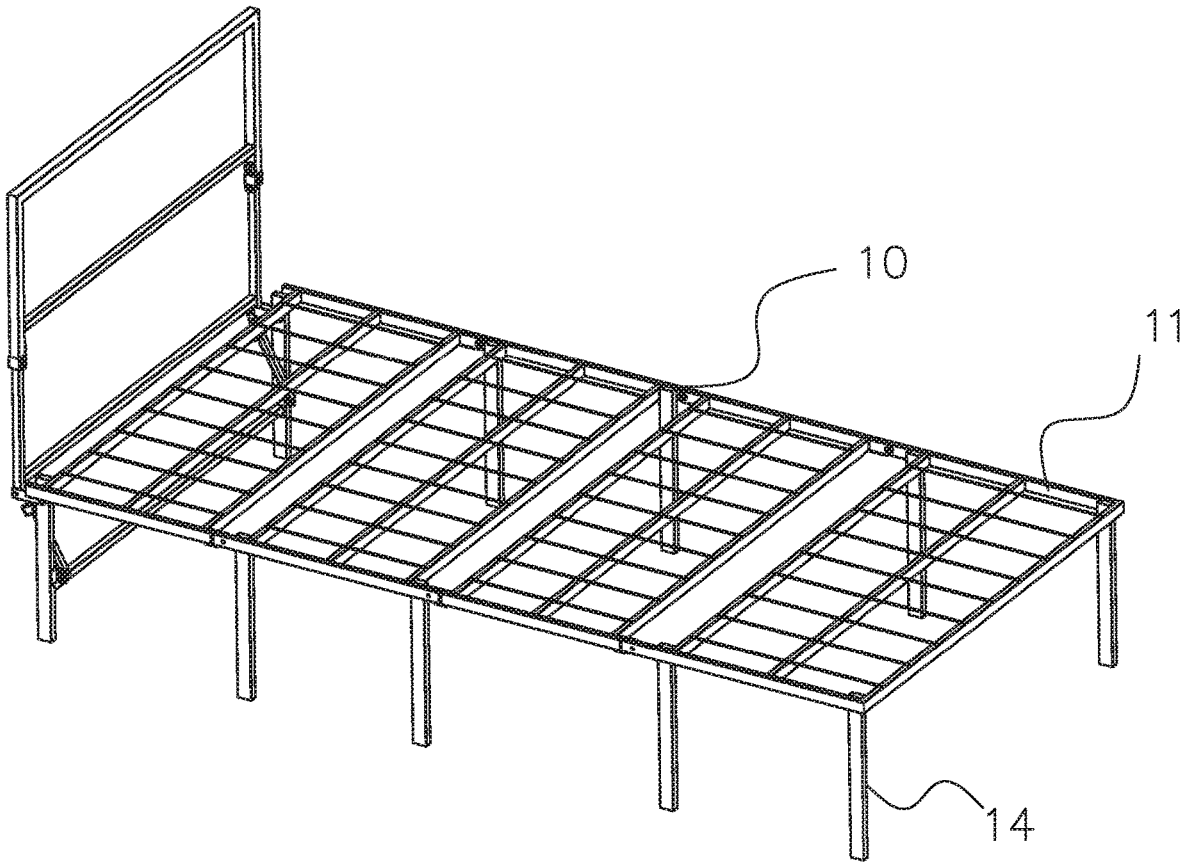
FIG. 1 is a schematic view of the folding bedstead in an unfolded state of the present invention.
Figure 2:
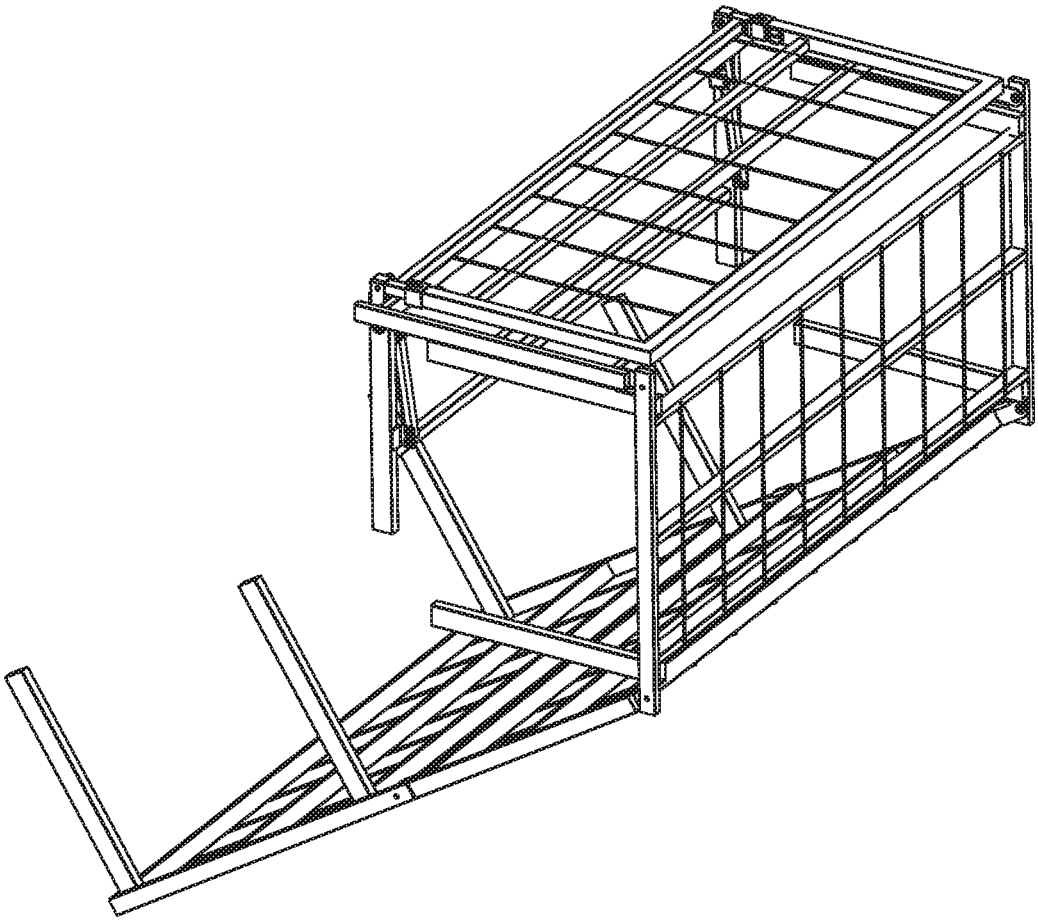
FIG. 2 is a schematic view of the folding bedstead in a half folded state of the present invention.
Figure 3:
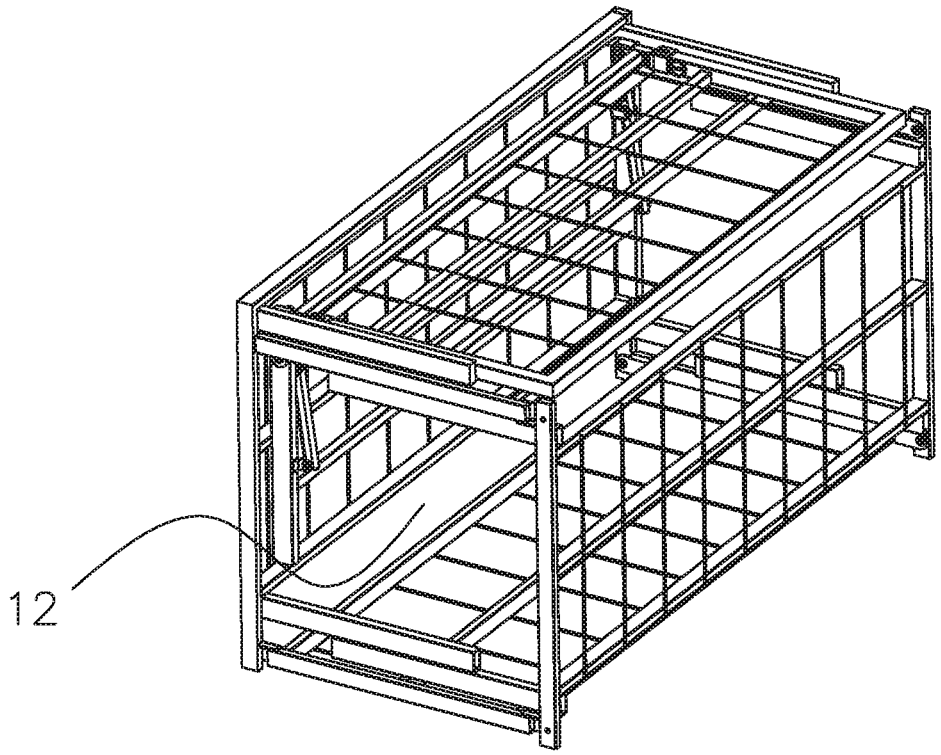
FIG. 3 is a schematic view of the folding bedstead in a folded state of the present invention.
Figure 4:
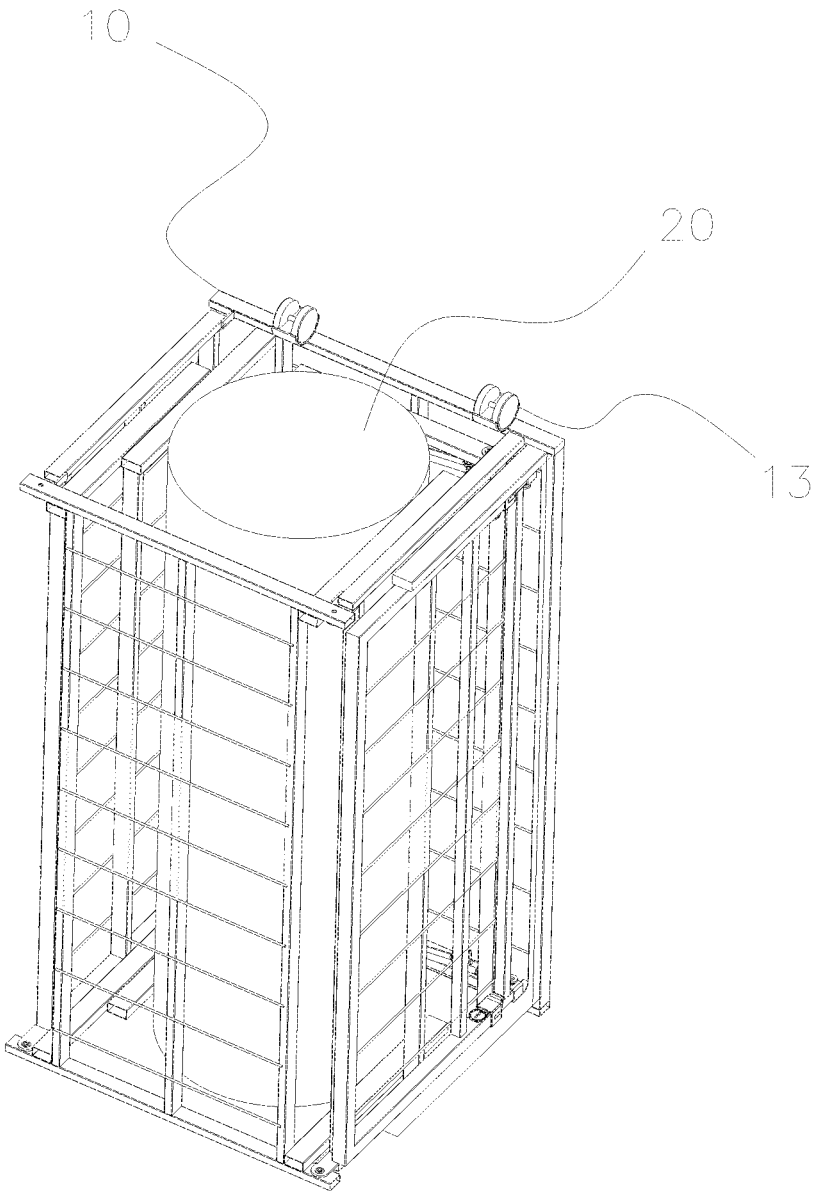
FIG. 4 is a schematic view of the rolled mattress disposed in the folding bedstead of the present invention.
Figure 5:
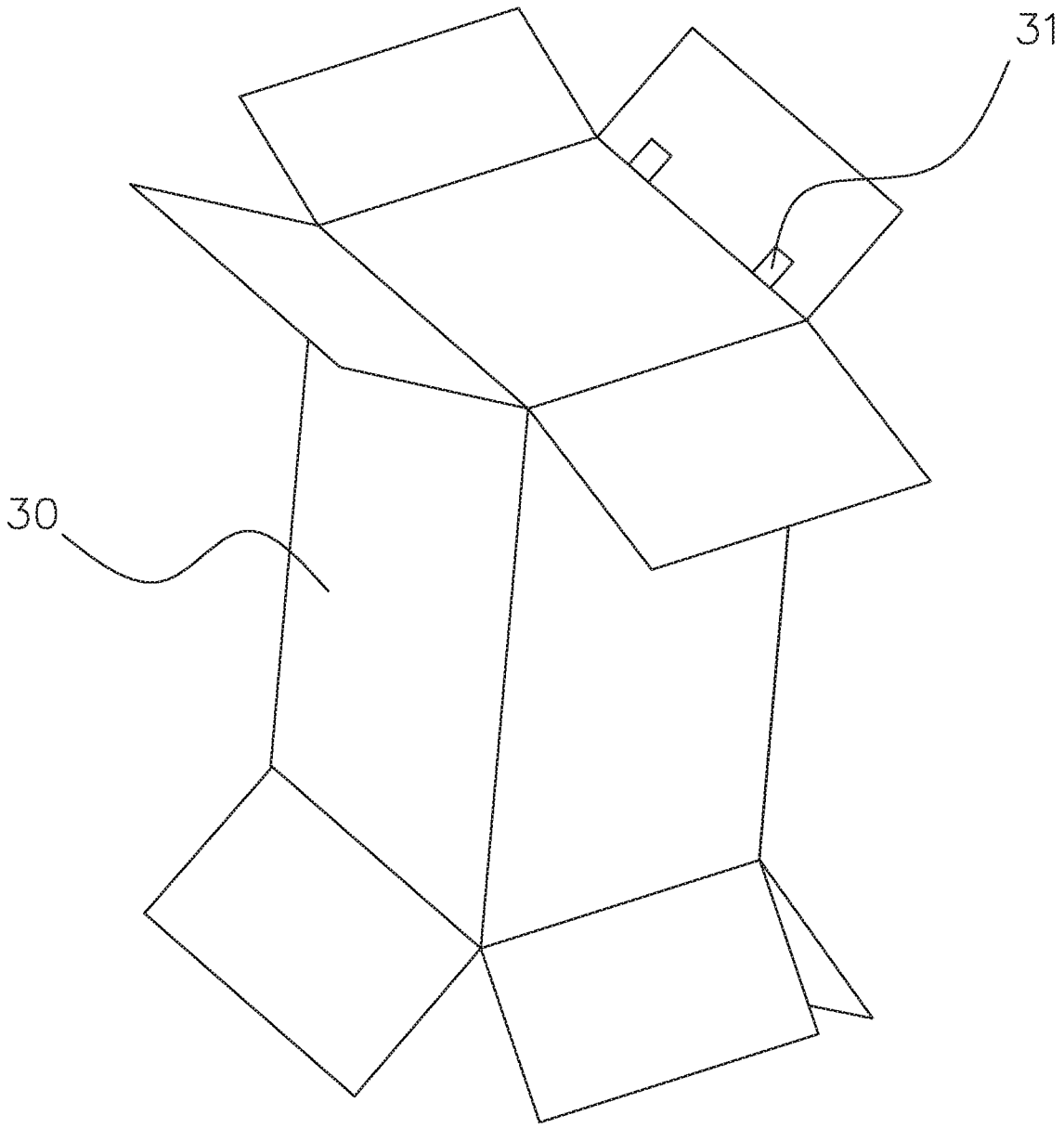
FIG. 5 is a schematic diagram of a box of the present invention.
Figure 6:
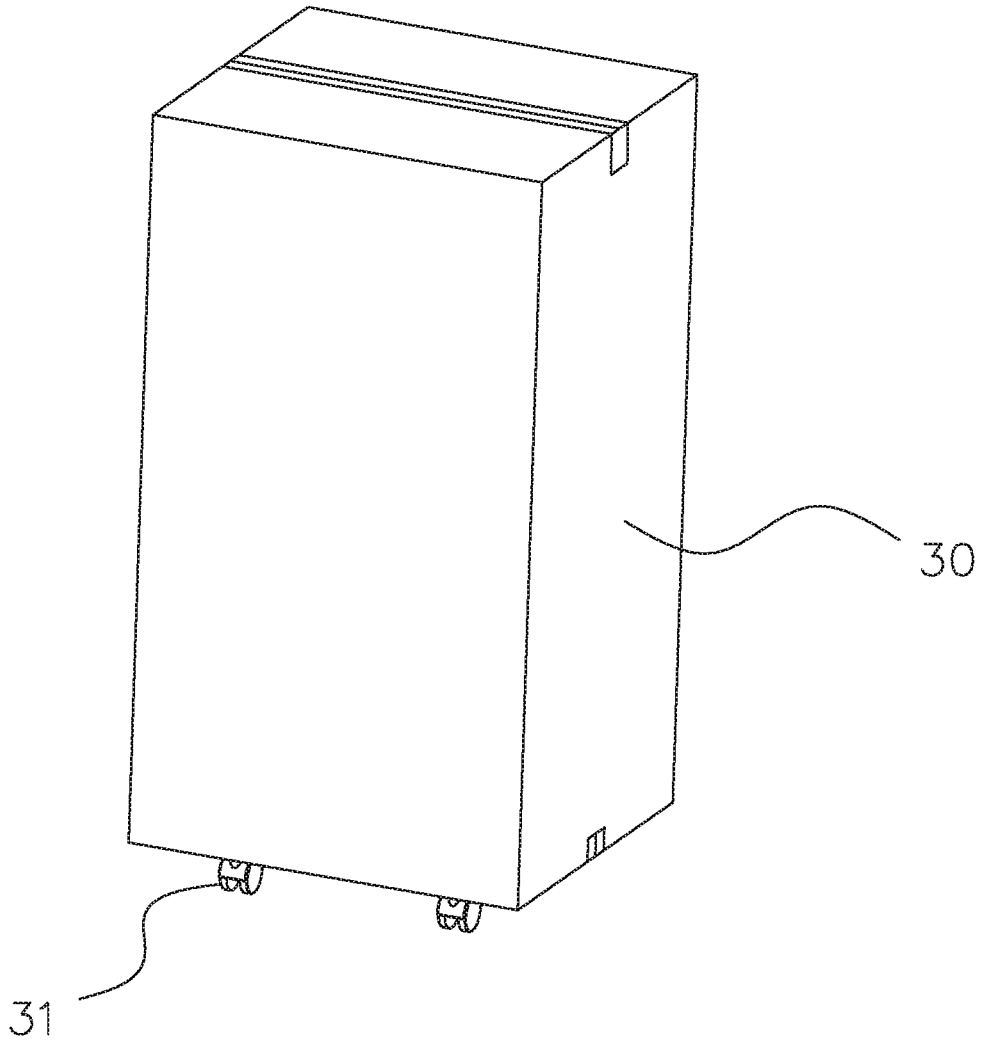
FIG. 6 is a schematic view of the folding bed of the present invention after packaging.

Hereinafter, the technical schemes of the embodiments of the invention will be described clearly and completely with reference to the drawings of the embodiments in the invention, obviously, the described embodiments are only a part of the embodiments of the invention, rather than all the embodiments. Based on the embodiment of the invention, all other embodiments obtained by those skilled in the art without creative work belong to the protection scope of the invention.

Referring to the drawings of the specification, the packaging structure of the folding bed includes a folding bedstead 10 including at least three unit frames 11. Adjacent unit frames are hinged to each other, and a mattress 20 capable of being rolled up. When the folding bedstead is packaged, the unit frames form a space 12 for receiving the rolled mattress.

More particularly, the present invention also includes a box 30 for receiving the folding bedstead in the packaged state and the rolled mattress, the size of the box is equal to the space occupied by the folding bed during transportation.

In order to simplify the job of workers during transportation, through holes 31 are formed on one edge of the box, roller wheels 13 are arranged on the side of one of the unit frames, and the roller wheels 13 extend out of the box through the through holes; after packaging, the roller wheels are located outside the box, so that the box can be moved, reducing the carrying and lifting required of workers. Of course, the roller wheel can be disassembled, when the folding bed is unfolded and used, the roller wheel is disassembled without hindering the normal use of the folding bed.

In an embodiment, the folding bedstead further includes support legs 14 welded under the unit frames. More specifically, support legs perpendicular to the unit frames are welded under the unit frame.

In a preferred embodiment of the present invention, the folding bedstead includes three unit frames or four unit frames. When the folding bedstead is packaged, the adjacent unit frames are perpendicular to each other.

When the folding bedstead is three unit frames, the adjacent unit frames are vertical, and the folding bedstead, the unit frame and the support feet form a square where the rolled mattress is arranged during transportation due to the vertical relationship between the support legs and the unit frames.

When the folding bedstead is four unit frames, the adjacent unit frames are vertical, when the folding bedstead is transported, the four unit frames form a square space which is used for receiving the rolled mattress, with specific reference to the drawings of the specification.

The invention also discloses another technical feature:

a packaging method of the folding bed, which includes the following steps:

S1: folding the unit frames of the folding bedstead to form a space;

S2: rolling up the mattress and putting the rolled mattress into the space formed by the unit frames;

S3: putting the folded folding bedstead into the box.

Before S2, installing the roller wheels on the unit frames, aligning the roller wheels with the through holes of the box, and placing the folding bed frame in the box.

Further included in S4: sealing the box.

The above disclosure is merely preferred embodiments of the present invention, and certainly not to limit the scope of the present invention. Therefore, equivalent changes made according to the claims of the present invention shall still belong to the scope of the invention.

What is claimed is:

1. A packaging structure of a folding bed, comprising:

a folding bedstead comprising at least three unit frames, the adjacent unit frames of the at least three unit frames are hinged with each other;

a mattress capable of being rolled up; and a box for receiving the folding bedstead in a packaged state and the mattress being rolled up, wherein when the folding bedstead is packaged, a space for receiving the mattress being rolled up is formed by the at least three unit frames, wherein a plurality of through holes are formed on one edge of the box, and a plurality of roller wheels are arranged on a side of one of the at least three unit frames and extend out of the box through the plurality of through holes.

2. The packaging structure of the folding bed according to claim 1, wherein the folding bedstead further comprises a plurality of support legs welded under the at least three unit frames.

3. The packaging structure of the folding bed according to claim 2, wherein the plurality of supporting legs perpendicular to the at least three unit frames are welded under the at least three unit frames.

4. The packaging structure of the folding bed according to claim 3, wherein the folding bedstead comprises three unit frames or four unit frames.

5. The packaging structure of the folding bed according to claim 4, wherein when the folding bedstead is packaged, the adjacent unit frames of the three unit frames or four unit frames are perpendicular to each other.

6. The packaging structure of the folding bed according to claim 1, wherein the plurality of supporting legs perpendicular to the at least three unit frames are welded under the at least three unit frames.

7. The packaging structure of the folding bed according to claim 6, wherein the folding bedstead comprises three unit frames or four unit frames.

8. The packaging structure of the folding bed according to claim 7, wherein when the folding bedstead is packaged, the adjacent unit frames of the three unit frames or the four unit frames are perpendicular to each other.

9. The packaging structure of the folding bed according to claim 1, wherein the folding bedstead comprises three unit frames or four unit frames.

10. The packaging structure of the folding bed according to claim 9, wherein when the folding bedstead is packaged, the adjacent unit frames of the three unit frames or the four unit frames are perpendicular to each other.

11. A packaging method of a packaging structure of a folding bed, comprising the following steps:

S1, folding a plurality of unit frames of a folding bedstead to form a space;

S2, rolling up a mattress to form a rolled mattress and putting the rolled mattress into the space formed by the plurality of unit frames to form a folded folding bedstead;

S3: putting the folded folding bedstead into a box, wherein before S2, a plurality of roller wheels are installed on the plurality of unit frames, aligning the plurality of roller wheels with a plurality of through holes of the box.

12. The packaging method of the packaging structure of the folding bed according to claim 11, further comprising S4: sealing the box.

* * * * *